US008142872B2

(12) United States Patent
Susa et al.

(10) Patent No.: US 8,142,872 B2
(45) Date of Patent: Mar. 27, 2012

(54) VEHICULAR UPHOLSTERY POLYPROPYLENETEREPHTHALATE FIBER FABRIC

(75) Inventors: Daisuke Susa, Wako (JP); Hidehito Fukumoto, Wako (JP); Takeko Tamura, Yasu (JP)

(73) Assignees: Honda Motor Co., Ltd., Kyoto (JP); TB Kawashima Co., Ltd., Aichi (JP)

( * ) Notice: Subject to any disclaimer, the term of this patent is extended or adjusted under 35 U.S.C. 154(b) by 581 days.

(21) Appl. No.: 12/294,964

(22) PCT Filed: May 9, 2007

(86) PCT No.: PCT/JP2007/059999

§ 371 (c)(1),
(2), (4) Date: Jun. 24, 2009

(87) PCT Pub. No.: WO2007/132872

PCT Pub. Date: Nov. 22, 2007

(65) Prior Publication Data

US 2010/0227109 A1 Sep. 9, 2010

(30) Foreign Application Priority Data

May 15, 2006 (JP) ..... 2006-134696

(51) Int. Cl.
*D03D 15/00* (2006.01)
*D03D 27/18* (2006.01)
*D02G 3/42* (2006.01)

(52) U.S. Cl. ..... 428/89; 428/88; 442/190; 442/192; 442/208; 139/393; 139/395

(58) Field of Classification Search ..... 428/88, 428/89; 442/189, 190, 192, 203, 208, 209; 139/393, 395
See application file for complete search history.

(56) References Cited

U.S. PATENT DOCUMENTS 1,755,839 A * 4/1930 Rodier ..... 139/385
6,780,800 B2 * 8/2004 Itoh ..... 442/190

FOREIGN PATENT DOCUMENTS

JP 48004219 Y1 2/1973
JP 5976947 5/1984
JP 1033212 2/1998

(Continued)

OTHER PUBLICATIONS

International Search Report of PCT/JP2007/059999 mailed on Aug. 21, 2007.

*Primary Examiner* — Jenna Johnson
(74) *Attorney, Agent, or Firm* — Leason Ellis LLP.

(57) ABSTRACT

Vehicular upholstery fabric is woven by using chenille yarn and multi-fiber yarn for weft yarns. The weaving interval between chenille yarns is set up less than the apparent thickness of the chenille yarn, which is specified as an observed value of the thickness. The apparent thickness of the multi-fiber yarn is less than one-fifth of the apparent thickness of the chenille yarn. There are tight portions where a great number of warp yarns passes over the chenille yarn, and rough portions, where a small number of warp yarns passes over the chenille yarn that is formed on the surface of fabric. PPT-fibers are used for the pile of the chenille yarn and the warp yarn.

7 Claims, 1 Drawing Sheet

FOREIGN PATENT DOCUMENTS

| | | | | |
|---|---|---|---|---|
| JP | 1033213 | | | 2/1998 |
| JP | 2003313743 | A | | 11/2003 |
| JP | 2003328249 | A | | 11/2003 |
| JP | 2004204362 | A | | 7/2004 |
| JP | 200589873 | | | 4/2005 |
| JP | 2005224471 | A | * | 8/2005 |
| JP | 2007113130 | A | | 5/2007 |

* cited by examiner

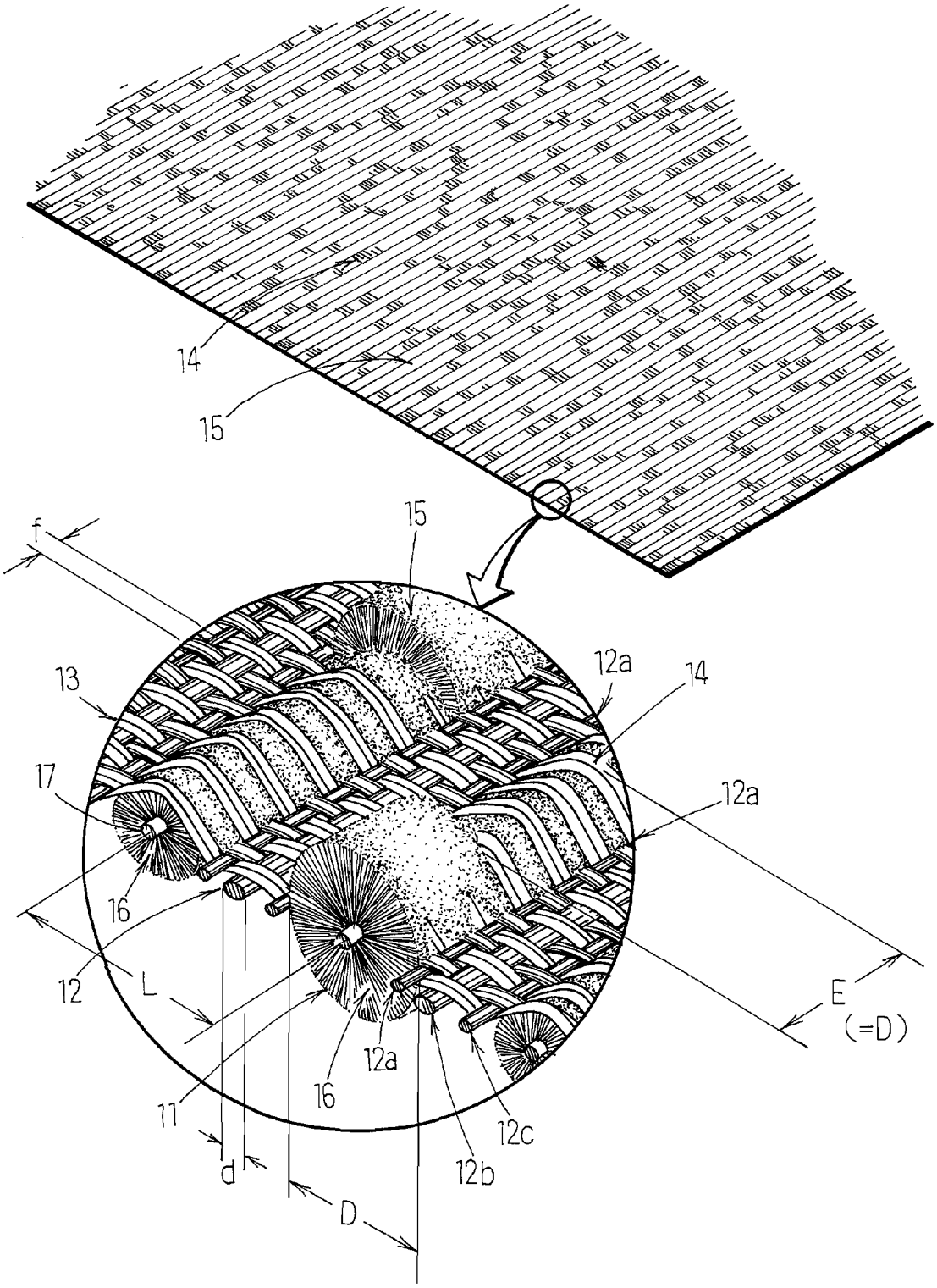
14
15
f
15
13
12a
14
17
12a
16
12
L
E
(=D)
12a
16
11
12c
d
12b
D

VEHICULAR UPHOLSTERY POLYPROPYLENETEREPHTHALATE FIBER FABRIC

CROSS-REFERENCE TO PRIOR APPLICATION

This is the U.S. National Phase Application under 35 U.S.C. §371 of International Patent Application No. PCT/JP2007/059999 filed May 9, 2007, which claims the benefit of Japanese Patent Application No. 2006-134696 filed May 15, 2006, both of them are incorporated by reference herein. The International Application was published in Japanese on Nov. 22, 2007 as WO2007/132872 a1 under pct article 21(2).

BACKGROUND OF THE INVENTION

1. Field of the Invention

The present invention relates to a vehicular upholstery fabric mainly composed of polypropyleneterephthalate fibers.

2. Description of the Related Art

For preservation of the global environment, natural fibers such as cotton, linen, silk, wool, and the like are preferably used since these fibers do not depend on petroleum resources.

In this regard, a polypropyleneterephthalate fiber, hereinafter referred to as "PPT-fiber", and a polylacticacid fiber, are synthetic fibers that can be produced from natural plant fibers rather than from petroleum.

Japanese Patent Laid Open No. 2000-154457, Japanese Patent Laid Open No. 2002-004156, Japanese Patent Laid Open No. 2003-105653, Japanese Patent Laid Open No. 2000-328393, and Japanese Patent Laid Open No. 2005-113279 disclose PPT-fiber and polylacticacid fiber that can be used for a vehicular upholstery fabric. Japanese Patent Laid Open No. 2004-404362 discloses a vehicular upholstery fabric that has a high and low pile pattern fabric made from chenille yarns having pile lengths from a core yarn.

Since the vehicular upholstery fabric is used under severe conditions, a polyethyleneterephthalate fiber is mainly used for the vehicular upholstery fabric because natural fibers and rayon fibers are lacking in durability. Thus, natural fibers and rayon fibers are not desirably used for vehicular upholstery fabric.

In this regard, PPT-fibers and polylacticacid fibers are not unexpected as new materials used for vehicular upholstery fabric, since the chemical formulas of polypropyleneterephthalate and polylacticacid are similar to the chemical formula of polyethyleneterephthalate, also known as "PET".

However, polylacticacid fiber is lacking in corrosion resistance since it is a type of biodegradable fiber. Further, polylacticacid fiber is lacking in the ability to absorb dyes.

Therefore, in the case of the application of polylacticacid fiber for use as a vehicular upholstery fabric, it must be chemically treated.

In this regard, in comparison with PET-fiber, the Young's Modulus of PPT-fiber is lower, the rate of elastic recovery of PPT-fiber is higher, and PPT-fiber is rich in flexibility and stretching property.

Thus, it is expected that vehicular upholstery fabric having an agreeable texture will be obtained by using PPT-fiber rather than PET-fiber.

However, in a chenille yarn formed from a PPT-fiber, its pile called "decorative yarn" and core yarn are merely fitting together.

Thus, in the case of the application of pile fabric formed from chenille yarn, of which piles are composed of PPT-fibers, to the portions of a seat cover, a backrest, an armrest and the like, where human extremities touch, the piles easily fall off due to physical movements of the extremities.

Because, with regard to pile fabric, the chenille yarn is stretched elastically, repeatedly and alternately following the movements of other warp yarns and other weft yarns of the pile fabric. As a result, the portions where the core yarn and piles of the chenille yarn fit together gradually become loosened by fatigue.

Further, in the weaving process of the high and low pile pattern fabric disclosed in Japanese Patent Laid Open No. 2004-404362, it needs to meet the bumpy portion of the chenille yarn to the high low pattern portion one by one at every time of weaving the chenille yarn.

This positioning pattern must be carried out by hand, by visually checking the bumpy portions of the chenille yarn and the pattern portions.

Accordingly, the weaving efficiency of the high and low pile pattern fabric disclosed in Japanese Patent Laid Open No. 2004-404362 is extremely low.

In addition, the chenille yarn used for high and low pile pattern fabric is highly expensive in comparison with the general chenille yarn of simple colour which does not have designed irregularities on its surface.

Thus, though the high and low pile pattern fabric disclosed in Japanese Patent Laid Open No. 2004-404362 may be suitable for decorative and artistic woven fabric handicrafts such as dress belts, thick curtains and the like, it is not suitable for mass produced fabrics such as vehicular upholstery fabric and the like.

Therefore, an object of the present invention is to obtain the high and low pile pattern fabric suitable for the vehicular upholstery fabric by using general chenille yarn in simple colour without using highly expensive chenille yarn for the high and low pile pattern fabric.

Another object of the present invention is to apply PPT-fiber to the pile fabric formed by using chenille yarns for weft yarn.

Another object of the present invention is to effectively use the character of PPT-fiber which is superior in stretching property.

Further, another object of the present invention is to obtain, by using PPT-fiber, a high and low pile pattern fabric which is agreeable to the touch, superior in durability, and suitable for use as vehicular upholstery fabric.

SUMMARY OF INVENTION

The vehicular upholstery PPT-fiber fabric, of the present invention has:

(a) a chenille yarn (11) and a multi-fiber yarn (12) used for weft yarns and threaded in between warp yarns (13,13) successively in order;

(b) a weaving interval (L) between chenille yarns (11,11), which are woven in repeatedly and adjacent longitudinally back and forth, said weaving interval being less than twice of the apparent thickness (D) of the chenille yarn (11), which is specified as an observed value of the thickness of the chenille yarn ($L \leqq 2D$);

(c) an apparent thickness (d) of the multi-fiber yarn (12), which is specified as an observed value of the thickness of the multi-fiber yarn, is less than one-fifth of the apparent thickness (D) of the chenille yarn (11) ($D \geqq 5d$);

(d) where the warp yarn (13) selectively passes over the chenille yarn (11);

(e) where the surface of the fabric is formed with tight portions (14) that have a great number (n) of warp yarns (13) that pass over the chenille yarn (11) and rough portions (15) that have a small number (n) of warp yarns (13) that pass over the chenille yarn (11);

such that at the tight portion (14), the numbers (n) of warp yarns (13) passed over the chenille yarn (11) are more than 5 (threads) per unit length (E), which corresponds to the apparent thickness (D) of the chenille yarn (11) (5≦n: threads/E), and such that at the rough portion (15), the number (n) of warp yarns (13) that pass over the chenille yarn (11) are less than 3 (threads) per unit length (E), which corresponds to the apparent thickness (D) of the chenille yarn (11) (3≧n: threads/E), and (f) the pile (16) of the chenille yarn (11) and the warp yarn (13) are respectively formed from PPT-fiber.

In addition, the pile (16) of the chenille yarn (11), the warp yarn, and the multi-fiber yarn (12) used for the weft yarn are formed from PPT-fiber of which the single fiber fineness is less than 3 dtex. In addition, a core yarn (17) of the chenille yarn is formed from the PET-fiber and the tight portion (14) and the rough portion (15) are formed respectively from at least the unit area of 2 square cm (4 $cm^2$) of the vehicular upholstery PPT-fiber fabric.

BRIEF DESCRIPTION OF THE DRAWINGS

FIG. 1 shows a perspective view of the vehicular upholstery polytrimethyleneterephthalate fiber fabric of the present invention.

DESCRIPTION OF THE PREFERRED EMBODIMENTS

The vehicular upholstery PPT-fiber fabric, of the present invention has:

(a) a chenille yarn (11) and a multi-fiber yarn (12) used for weft yarns and threaded in between warp yarns (13,13) successively in order;

(b) a weaving interval (L) between chenille yarns (11,11), which are woven in repeatedly and adjacent longitudinally back and forth, said weaving interval being less than twice of the apparent thickness (D) of the chenille yarn (11), which is specified as an observed value of the thickness of the chenille yarn (L≦2D);

(c) an apparent thickness (d) of the multi-fiber yarn (12), which is specified as an observed value of the thickness of the multi-fiber yarn, is less than one-fifth of the apparent thickness (D) of the chenille yarn (11) (D≧5d);

(d) where the warp yarn (13) selectively passes over the chenille yarn (11);

(e) where the surface of the fabric is formed with tight portions (14) that have a great number (n) of warp yarns (13) that pass over the chenille yarn (11) and rough portions (15) that have a small number (n) of warp yarns (13) that pass over the chenille yarn (11);

such that at the tight portion (14), the numbers (n) of warp yarns (13) passed over the chenille yarn (11) are more than 5 (threads) per unit length (E), which corresponds to the apparent thickness (D) of the chenille yarn (11) (5≦n: threads/E), and such that at the rough portion (15), the number (n) of warp yarns (13) that pass over the chenille yarn (11) are less than 3 (threads) per unit length (E), which corresponds to the apparent thickness (D) of the chenille yarn (11) (3≧n: threads/E), and (f) the pile (16) of the chenille yarn (11) and the warp yarn (13) are respectively formed from PPT-fiber.

In addition, the pile (16) of the chenille yarn (11), the warp yarn, and the multi-fiber yarn (12) used for the weft yarn are formed from PPT-fiber of which the single fiber fineness is less than 3 dtex. In addition, a core yarn (17) of the chenille yarn is formed from the PET-fiber and the tight portion (14) and the rough portion (15) are formed respectively from at least the unit area of 2 square cm (4 $cm^2$) of the vehicular upholstery PPT-fiber fabric.

A pile surface formed of cut piles is not slippery, since the tip of pile fiber (16) pushes into fine openings which exist between fibers of clothes. Thus, physical movement is hindered when sitting or placing human extremities on the napped pile surface, such as a portion of a backrest where the extremities realize a stiff feeling, and occasionally a fatiguing feeling.

In this regard, the tight portion (14) of the pile surface, in accordance with the present invention, is flat and slippery since the piles (16) of the chenille yarn (11) are covered by a number of warp yarns (13). In this manner, the stiff and fatiguing feeling caused by the non-slip nature of the pile surface are relieved.

Further, the piles (16) of the chenille yarn covered by the warp yarns (13) are suppressed in the weaving process where the tension of the warp yarns (13) acts to suppress the piles. As a result, the tight portion (14) forms a recessed part or configuration on the pile surface relative to the rough portion (15).

However, the warp yarn (13) becomes soft after weaving, since the tension does not act on the warp yarn (13) after weaving.

Then, the pile (16) is suppressed by the warp yarn (13) and thereby recovers its bulkiness. Then, the warp yarn (13) of the tight portion (14) is pushed up by the pile (16). As a result, the warp yarn (13) of the tight portion (14) forms a loop-pile-like protuberance.

For the formation of the loop-pile-like protuberance, it is preferable to use a fiber for the warp yarn (13) that has a single fiber fineness of less than 3 dtex, as well as a single fiber fineness of the chenille yarn.

It is also preferable to use a non-twisting bulky PPT-multifilament yarn for the warp yarn (13), so that the surface of the fabric, which is formed with the rough portion (15) covered with the cut pile (16) of the chenille yarn and the tight portion (14) having loop-pile-like protuberances where the cut pile (16) of chenille yarn is covered by numbers of warp yarns (13), have the appearance of a cut and loop pile pattern fabric whose surface is formed with cut piles and loop piles.

At the tight portion (14), the elastic recovery force caused from the cut pile (16) of chenille yarn acts to push up the loop-pile-shaped warp yarn (13). Thus, due to the PPT-fiber which is superior in stretching property than the fiber used for both warp yarns (13) and cut piles (16), the result is a beautiful appearance and a texture similar to a surface of a cut and loop pile pattern fabric as a result of the tight portion (14) and the rough portion (15).

The tight portion (14) and the rough portion (15) can be selectively formed by the operation of a jacquard apparatus, dobby apparatus, and the like. As a result, a decorative pattern can be drawn out over the surface of the fabric in accordance with the difference of the appearance of the tight portion (14) versus the appearance of the rough portion (15).

Therefore, a high and low pile pattern fabric can be produced efficiently without using the highly expensive chenille yarn disclosed in Japanese Patent Laid Open No. 2004-404362.

When the PPT-fiber, which is rich in stretching property, is used for the multi-fiber yarn (12), or the weft yarn, and the PET-fiber, which is lacking in stretching property, is used for the core yarn (17) of the chenille yarn, the multi-fiber yarn (12) is elongated more than the core yarn (17) of the chenille yarn during the weaving process and the multi-fiber yarn (12)

shrinks more than the core yarn (17) of the chenille yarn after the weaving process. In this manner, the density of pile (16) of the chenille yarn becomes dense due to the difference of elongation of the chenille yarn and the multi-fiber yarn (12). Thus, when the multi-fiber yarn (12) shrinks after the weaving process due to the elastic recovery force of the PPT-fiber, the core yarn (17) is arranged in parallel with the multi-fiber yarn (12) and is brought into a compressed situation since the elastic recovery force of the multi-fiber yarn (12) acts upon the core yarn (17) of the chenille yarn after the weaving process.

As mentioned above, the core yarn (17) is in a compressed situation. Thus, the core yarn (17) stretches with the movements of the multi-fiber yarn (12) when the tensile stress acts upon the vehicular upholstery PPT-fiber fabric, and the multi-fiber yarn (12) stretches in accordance with the tensile stress.

Therefore, even though the PET-fiber, which is lacking in stretching property, is used for the core yarn (17) of the chenille yarn, it does not make the vehicular upholstery PPT-fiber fabric hard to stretch, and does not disturb the moulding property of the vehicular upholstery PPT-fiber fabric.

Since the core yarn (17) is in a compressed condition in its longitudinal direction in the vehicular upholstery PPT-fiber, the core yarn (17) only recovers its original length when released from the compressed condition in its longitudinal direction, when the core yarn (17) stretches following to the stretching movements of the multi-fiber yarn (12). Thus, the tensile stress does not react to the core yarn (17) when the tensile stress reacts to the vehicular upholstery PPT-fiber fabric. In this manner, the core yarn (17) does not strain as much as the multi-fiber yarn (12).

Therefore, the portions of the core yarn (17) and piles (16) of the chenille yarn which are fit together do not easily turn into a loosened and fatigued condition. Accordingly, the piles (16) do not fall off at the rough portion (15).

Of course, the piles (16) of the tight portion (14) do not easily fall off since the piles (16) of the tight portion (14) are covered by the warp yarns (13).

Further, since the PPT-fiber is superior in stretching property, the shrinking stress, which was stored by elongation during the weaving process, continually reacts to the multi-fiber yarn (12) formed from the PPT-fiber. Thus, although the vehicular upholstery PPT-fiber fabric is stretched repeatedly, its weaving textile design prevents distortion.

Therefore, the chenille yarn (11) is maintained firmly and elastically by the weft yarn (multi-fiber yarn 12) and the warp yarn (13).

Also in this regard, the piles (16) do not easily fall off from the vehicular upholstery PPT-fiber fabric.

Where the tight portion (14) and the rough portion (15) are formed at least one among the unit area (4 $cm^2$), a ground pattern is drawn out over the surface of the fabric in accordance with the difference of the appearance of the tight portion (14) versus the rough portion (15).

On the vehicular upholstery fabric, there exist not only non-slippery rough portions (15), where the tip of pile fiber (16) pushes in between the fibers of the cloth, but also slippery tight portions (14), where the pile fibers (16) are covered by a number of warp yarns (13). Accordingly, physical movement is not disturbed, and the human extremities are supported stably on the vehicular upholstery fabric. Thus, the vehicular upholstery fabric has a beautiful appearance and a texture and feel similar to the surface of a cut and loop pile pattern fabric.

Further, as mentioned above, the vehicular upholstery fabric is rich in stretching property, its weaving textile design is not easily distorted, and the piles (16) do not easily fall off, even though the fabric is used as a seat cover, a backrest, an armrest, and the like, where the fabric is rubbed frequently by human extremities following physical movement upon use.

To prevent the piles (16) of the chenille yarn from falling off and to make the vehicular upholstery PPT-fiber fabric dimensionally stable, the back surface of the fabric may be coated with a backing of resin adhesive.

Also, a backing fabric may be adhered over the back surface of the PPT-fiber fabric.

One or more plural threads, preferably three to five threads, of multi-fiber yarns (12) are woven in between adjacent chenille yarns (11,11). In the event that plural threads of multi-fiber yarns (12) are woven in between adjacent chenille yarns (11,11), it is desirable to make the multi-fiber yarns (12*a*,12*c*) which are woven in the front or in the rear of the chenille yarn (11) finer (thicker) than the multi-fiber yarn (12*b*) which is woven in between adjacent multi-fiber yarns (12*a*,12*c*), to make the juncture between the chenille yarn (11) and the multi-fiber yarns (12*a*,12*c*) clearer and more visible, thus forming a beautiful loop-pile-like loop with the warp yarn (13) passing over the chenille yarn (11).

For example, the chenille yarn (11), a fine multi-fiber yarn (12*a*), a thick multi-fiber yarn (12*b*), a fine multi-fiber yarn (12*c*), are woven in repeatedly, in order (as shown in FIG. 1).

In the event that the weaving interval (L) between adjacent chenille yarns (11,11) is longer than the apparent thickness (D) of the chenille yarn (11), such as when a ratio of the area of a plain woven portion is formed with the multi-fiber yarns (12), and the warp yarns (13) between adjacent chenille yarns (11,11) is increased, then, a beautiful appearance similar to the surface of a cut and loop pile pattern fabric does not appear over the surface of the PPT-fiber fabric, and the non-slip effect caused from the piles (16) of the rough portion (15) can not be expected, and the entirety of the fabric becomes slippery such that human extremities will slip and slide upon it. Accordingly, the weaving interval (L) between chenille yarns (11,11) should be set up less than the apparent thickness (D) of the chenille yarn (11).

On the other hand, in the event that the weaving interval (L) between chenille yarns (11,11) is too narrow, the non-slip effect caused from the piles (16) of the rough portion (15) increases more than needed. Thus, physical movement will be hindered when sitting or placing human extremities on the PPT-fiber fabric.

In consideration of these events, it is desirable to set up the weaving interval (L) between chenille yarns (11,11) from 1.0 to 1.5 times the apparent thickness (D) of the chenille yarn (11) (L=D~1.5 D).

The bulk of the protuberance, which is composed of the tight portion (14) and the rough portion (15) formed with the multi-fiber yarn (11) and which protrudes from the plain woven portion formed with the multi-fiber yarn (12) and the warp yarn (13), depends on the difference between the apparent thickness (d) of the multi-fiber yarn (12) and the apparent thickness (D) of the chenille yarn (11). Thus, the tight portion (14) and the rough portion (15) formed with the multi-fiber yarn (11) have the appearance of a loop pile and a cut pile which were tufted on a base fabric woven from a warp yarn, such as the warp yarn (15) and a weft yarn such as the multi-fiber yarn (12).

In consideration of these events, it is also desirable to set up the weaving interval (L) between chenille yarns (11,11) from 1.0 to 1.5 times the apparent thickness (D) of the chenille yarn (11) (L=D~1.5 D).

The total fineness of warp yarn (13) is set up to be less than 200 dtex, and the density of the warp is set up to be as dense as possible. For example, in the case of the apparent thickness (D) of the chenille yarn (11) being 2 mm, the density of the warp per unit length (E) is set up to be from 6 threads/E to 20 threads/E (6~20 threads/E). To make the loop-pile-like shaped warp yarn (13) that protrudes at the tight portion (14) rich in abrasion resistance, to avoid the distortion of the weaving textile design composed of the warp yarn and the weft yarn (chenille yarn and multi-fiber yarn), and to make the vehicular upholstery fabric rich in abrasion resistance, the single fiber fineness of the warp yarn (13) is set up to be more than 1 dtex, and the warp yarn (13) is arranged by grouping a plurality of warp yarns, for example, each group is composed of two threads of warp yarns, where at least one thread of the warp yarn of each group is selected to pass over every chenille yarn, and other warp yarns of each group, which are not selected to pass over the chenille yarn, are woven so that the warp yarns do not float out over the back surface of the fabric. In this case, the warp yarn passed under the chenille yarn (11) does not affect the texture or feel of the surface of the fabric, not only at the tight portion (14) but also at the rough portion (15). Thus, it is possible to set up the single fiber fineness of the warp yarn at more than 3 dtex and the total fineness of the warp yarn at more than 200 dtex. Such a twist yarn is a spun yarn, and can be used for the warp yarn. Of course, the warp yarn passing under the chenille yarn (11) is fixed by the multi-fiber yarn (12).

In the present invention, the number of the warp yarns (13) which pass over the chenille yarn (11) at the rough portion (15) is less than 3 (thread/E). Therefore, the number of the warp yarns (13) which pass over the chenille yarn (11) at the rough portion (15) may be 0 (zero) (thread/E). However, in the event that the number of the warp yarns (13) is 0 (zero) (thread/E) does not mean that the chenille yarn (11) is not fixed by the warp yarns (13), nor does it mean that the chenille yarn (11) floats out long over the surface of the fabric.

For example, in the case of the length of the rough portion (15) being more than two times the apparent thickness of the chenille yarn, the weaving textile design is set so that even though the number of the warp yarns (13) which passes over the chenille yarn (11) at one part of any rough portion (15) is 0 (zero) (thread/E), at least one thread of the warp yarns (13) passes over at the other part with an adjustment to that one part of the rough portion.

For example, if the apparent thickness (D) of the chenille yarn (11) is "X" mm, even though the extending length of the rough portion (15) is "n" times the apparent thickness (D), the weaving textile design is set so that at least one thread of the warp yarns (13) passes over at the extending rough portion (15). Thus, the number of the warp yarns (13) which pass over the chenille yarn (11) per unit length (E) is set up to be more than 1/n (threads/E). Specifically, if the apparent thickness (D) of the chenille yarn (11) is 2 mm, and the extending length of the rough portion (15) is 6 mm, then the number of the warp yarns (13) which passes over the chenille yarn (11) at the rough portion (15) is at least one. In this manner, the number of the warp yarns (13) which passes over the chenille yarn (11) per unit length (E) is more than ⅓ (threads/E).

If the chenille yarn floats long without being pushed down by the warp yarn, the piles (16) of the chenille yarn easily fall off. Thus, it is desirable to set the length of the extending rough portion (15) such that the warp yarns (13) do not pass over less than 3 times the apparent thickness (D) of the chenille yarn (11). It is also desirable to set the number (n) of the warp yarns (13) which pass over the chenille yarn (11) to be more than one-third (⅓≦n) at the rough portion (15) of the unit length (E=D).

In the present invention, "multi-fiber yarn" used for the warp yarn and the weft yarn means the yarn composed of multiple fibers. A spun yarn and a multifilament yarn are included in the meaning of "multi-fiber yarn". However, to ensure the strength of yarn, it is desirable to use multifilament yarn as the multi-fiber yarn.

A woven chenille yarn where the pile fiber (16) and the core yarn (17) are united with woven constructions, a knitted chenille yarn where the pile fiber and the core yarn are united with knitted constructions, and a flocky yarn where the pile fiber (16) is electrostatically flocked on the axis (17), are used as the chenille yarn.

PPT-fiber is produced by polycondensation of terephthalic acid and a diol such as 1-3-propandiol, 1-2-propandiol, 1-1-propandiol, 2-2-propandiol, and the like. PPT-fiber is also known as polytrimethyleneterephthalate fiber. One type of PPT-fiber is produced from petroleum. However, in connection with preservation of the global environment, it is desirable to use PPT-fiber which is produced from natural plant fibers rather than from petroleum. It is further desirable to use PPT-fiber which is made by polycondensation of 1-3-propandiol and terephthalic acid.

The invention claimed is:

1. A vehicular upholstery polypropyleneterephthalate fiber fabric comprising:

a chenille yarn and a multi-fiber yarn that are used for weft yarns and are threaded in between warp yarns in successive order;

a weaving interval between the chenille yarns, which are woven in repeatedly and adjacent longitudinally back and forth, is less than twice an apparent thickness of the chenille yarn, which is specified as an observed value of the thickness of the chenille yarn;

an apparent thickness of the multi-fiber yarn, which is specified as an observed value of the thickness of the multi-fiber yarn, is less than one-fifths of the apparent thickness of the chenille yarn;

wherein the warp yarn selectively passes over the chenille yarn;

tight portions where a large number of the warp yarns pass over the chenille yarn and rough portions where a small number of warp yarns pass over the chenille yarn are formed on the surface of the fabric; at the tight portion, the numbers of warp yarns passed over the chenille yarn are more than five threads per unit length, which corresponds to the apparent thickness of the chenille yarn;

at the rough portion, the numbers of warp yarn passed over the chenille yarn are less than three threads per unit length, which corresponds to the apparent thickness of the chenille yarn; and piles of the chenille yarn and the warp yarn are respectively formed from the polypropyleneterephthalate fiber.

2. A vehicular upholstery polypropyleneterephthalate fiber fabric according to claim 1, wherein:

the piles of the chenille yarn, the warp yarn, and the multi-fiber yarn used for the weft yarn are formed from the polypropyleneterephthalate fiber whose single fiber fineness is less than 3 dtex.

3. A vehicular upholstery polypropyleneterephthalate fiber fabric according to claim 1, wherein:

a core yarn of the chenille yarn is formed from the polyethyleneterephthalate fiber.

4. A vehicular upholstery-polypropyleneterephthalate fiber fabric according to claim 1, wherein:

the tight portion and the rough portion are formed respectively from at least one of the unit area of 2 square cm (4 $cm^2$) of the vehicular upholstery polypropyleneterephthalate fiber fabric.

5. A vehicular upholstery polypropyleneterephthalate fiber fabric according to claim 2, wherein:

a core yarn of the chenille yarn is formed from the polyethyleneterephthalate fiber.

6. A vehicular upholstery-polypropyleneterephthalate fiber fabric according to claim 2, wherein:

the tight portion and the rough portion are formed respectively from at least one of the unit area of 2 square cm (4 $cm^2$) of the vehicular upholstery polypropyleneterephthalate fiber fabric.

7. A vehicular upholstery-polypropyleneterephthalate fiber fabric according to claim 3, wherein:

the tight portion and the rough portion are formed respectively from at least one of the unit area of 2 square cm (4 $cm^2$) of the vehicular upholstery polypropyleneterephthalate fiber fabric.

* * * * *